US005944637A

United States Patent [19]

Stickler et al.

[11] Patent Number: 5,944,637

[45] Date of Patent: Aug. 31, 1999

[54] RESISTANCE DEVICE FOR BICYCLE TRAINERS

[75] Inventors: George D. Stickler, Shorewood; Gary R. Sorenson, Lakeville; Michael W. Beise, Mound, all of Minn.; Steve Traut; Jeff Q. Nichols, both of New York, N.Y.; Tyler Marthaler, Berkeley, Calif.

[73] Assignee: Graber Products, Inc., Madison, Wis.

[21] Appl. No.: 08/721,886

[22] Filed: Sep. 27, 1996

Related U.S. Application Data

[63] Continuation-in-part of application No. 08/494,503, Jun. 26, 1995, Pat. No. 5,611,759.

[51] Int. Cl.[6] ..... A63B 22/06; A63B 69/16

[52] U.S. Cl. ..... 482/61; 482/112

[58] Field of Search ..... 482/57, 61, 111, 482/112, 113, 63

[56] References Cited

U.S. PATENT DOCUMENTS

| | | | |
|---|---|---|---|
| 3,373,992 | 3/1968 | Ludeman . | |
| 3,494,616 | 2/1970 | Parsons . | |
| 4,171,802 | 10/1979 | Stoecker . | |
| 4,645,199 | 2/1987 | Bloemendaal | 482/58 |
| 4,741,529 | 5/1988 | Bloemendaal . | |
| 4,768,782 | 9/1988 | Blackburn | 482/61 |
| 4,822,037 | 4/1989 | Makansi et al. . | |
| 5,195,936 | 3/1993 | Mao . | |
| 5,472,392 | 12/1995 | Haan et al. . | |
| 5,611,759 | 3/1997 | Zeh et al. | 482/61 |

*Primary Examiner*—Stephen R. Crow

*Attorney, Agent, or Firm*—Lathrop & Clark LLP

[57] ABSTRACT

The present invention is directed to a bicycle trainer that permits a bicycle to be used for stationary riding. The bicycle trainer has a modular fluid resistance unit wherein resistance is provided by the rotation of an impeller against a fluid contained in a sealed housing. The resistance unit provides selectively variable resistance, is quiet to use, and simulates bicycle riding on a road.

8 Claims, 8 Drawing Sheets

RESISTANCE DEVICE FOR BICYCLE TRAINERS

This application is a continuation-in-part of U.S. application Ser. No. 08/494,503, filed Jun. 6, 1995, which issued as U.S. Pat. No. 5,611,759, on Mar. 18, 1997.

BACKGROUND OF THE INVENTION

The present invention relates generally to exercise devices, including exercise cycles, and more particularly to support devices commonly known as bicycle trainers, including an adjustable resistance producing unit.

For many years, bicycle trainers have been used by bicycling enthusiasts to support their bicycles for stationary riding. Rather than ride in cold or rainy weather, a cyclist can use the trainer to ride indoors and obtain an aerobic, cardiovascular workout. Bicycle trainers also obviate the need for purchasing a separate stationary bicycle for persons who want to occasionally work out while, for example, reading or watching television. Regardless of the reasons for its use, a bicycle trainer should be easy to use and, to the extent possible, simulate bicycle riding on the open road.

A typical bicycle trainer has a frame onto which a user mounts a bicycle. The rear wheel of the bicycle contacts a roller or like mechanism connected to a resistance unit. The existing technologies used in bicycle trainers and many other forms of exercise equipment to provide resistance include: frictional systems that use, for example, belts and pulleys; magnetic systems that use permanent and electromagnets; and fan units. Resistance to exercise and, in the case of bicycle trainers, to the rotation of the rear wheel may be adjustable, and should provide smooth action at various speeds. In addition, it would be desirable for a resistance unit to provide increased resistance as the rotation of the wheel is increased, so that more energy is required to pedal the bicycle and the rider receives a greater workout. As fitness improves, i.e., as a target rpm or cadence is achieved and can be maintained, it would be advantageous to increase resistance to improve a rider's speed.

Resistance units that employ the technologies noted above, although they may include variable resistance, often do not provide smooth action at varying speeds, particularly at transitions to and from various speeds (or rpm), and can also be very noisy.

It is known that fluids can be used as a medium for providing resistance. However, there is no bicycle trainer available currently that effectively uses a fluid in a resistance unit to provide smooth, quiet, adjustable resistance.

SUMMARY OF THE INVENTION

The problem outlined above is in large part solved by the exercise device and fluid resistance unit in accordance with the present invention. In one embodiment, the exercise device includes a frame, a sealed, fluid containing housing carried by the frame, an impeller in the housing and carried on a rotatable shaft extending out of the housing, wherein the shaft is rotated by an exerciser, the housing further including a main chamber and a reservoir in fluid communication with the main chamber and means for moving fluid between the main chamber and reservoir. In contrast to known resistance mechanisms, the resistance unit of the present invention provides for selectively variable resistance in a fluid resistance unit.

It is an object of the present invention to provide an exercise device with a fluid resistance, wherein the fluid resistance unit enables safe, quiet, smoothly variable resistance.

It is another object of the present invention to provide a bicycle trainer with a fluid resistance unit offering progressive resistance to match the energy output of the user.

Another object of the present invention is to provide a fluid resistance unit that is compact and comprises a unitary mountable module.

Accordingly, the present invention is directed to a trainer having a frame and a modular fluid resistance unit removably attached to the frame. The resistance unit resists movement of a driven member driven by an exerciser, typically through a pedal/crank arrangement. In one embodiment, the resistance unit includes a rotatable shaft for operably engaging the driven wheel. The rotatable shaft carries an impeller encased by a sealed housing containing a fluid. The fluid provides resistance against the rotational movement of the impeller. The resistance is made adjustable by providing structural, mechanical features that allow the taking advantage of the boundary and/or volume effects of fluid mechanics, particularly tangential shearing forces causing turbulant flow, viscosity, viscous friction and/or fluid friction. A flywheel may be attached to the rotatable shaft to provide momentum.

These and other objects, features and advantages of the present invention will become more apparent with reference to the referenced drawings, the description of the preferred embodiment and the appended claims.

DETAILED DESCRIPTION OF THE PREFERRED EMBODIMENTS

The Figures depict the exercise device of the present invention and features and components thereof. Although the preferred embodiment of the device takes the form of a "bicycle trainer," the device could be configured as an "exercycle," having bicycle-like drive train, seat and handlebar arrangements integrated with the frame and resistance unit.

With regard to means for fastening, mounting, attaching or connecting the components of the present invention to form the exercise device as a whole, unless specifically described as otherwise, such means are intended to encompass conventional fasteners such as machine screws, rivets, nuts and bolts, toggles, pins, and the like. Other fastening or attachment means appropriate for connecting components include adhesives, welding (e.g., frame members) and soldering, the latter particularly with regard to electrical connections. Unless specifically otherwise disclosed or taught, materials for making the components of the present invention may be selected from appropriate materials such as aluminum, steel, metallic alloys, various plastics, plexiglass, fiberglass and the like.

Figure 2:
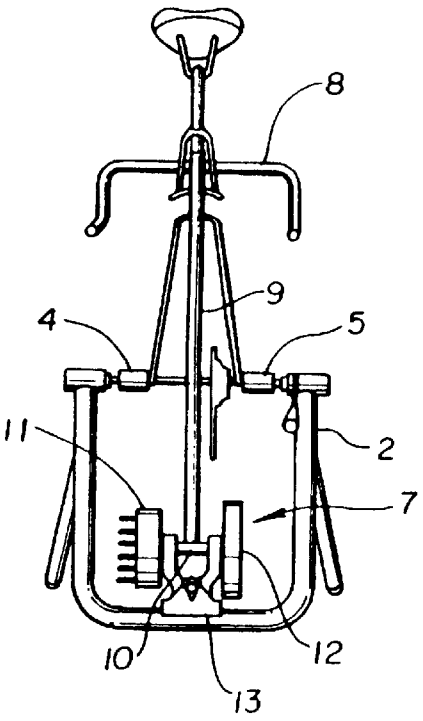
FIG. 2 is a rear elevational view of the trainer depicted in FIG. 1 with a bicycle positioned for use by a rider.
Figure 1:
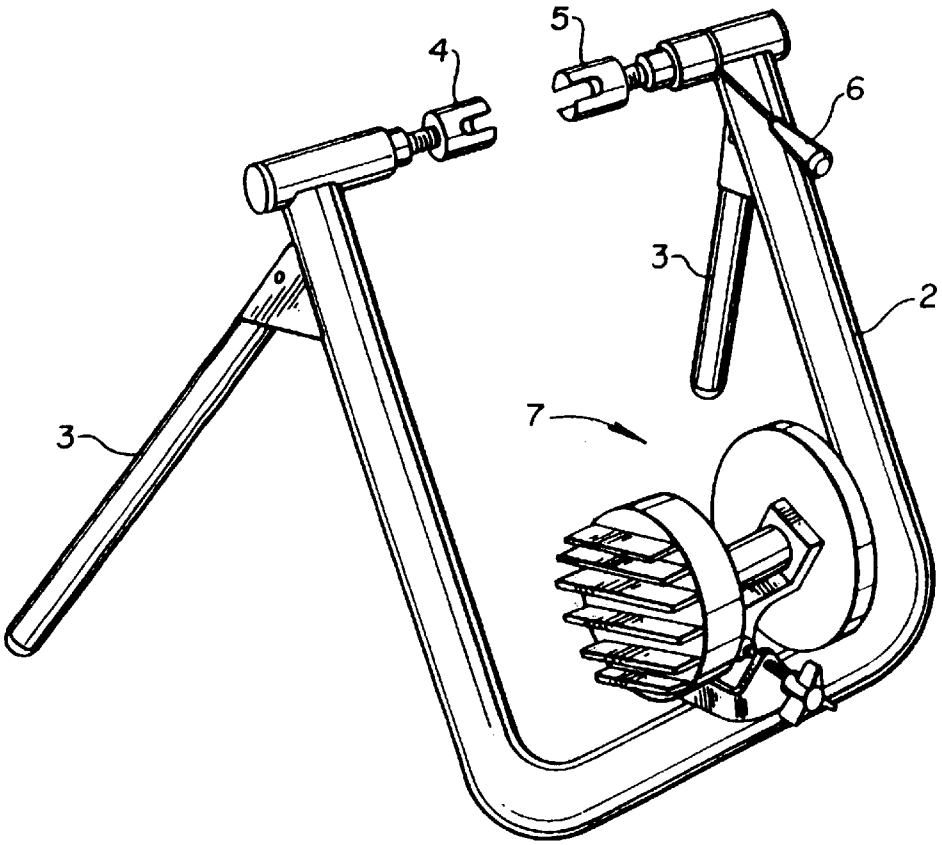
FIG. 1 is an isometric view of a bicycle trainer in accordance with the present invention, including a fluid resistance unit.
Figure 8:
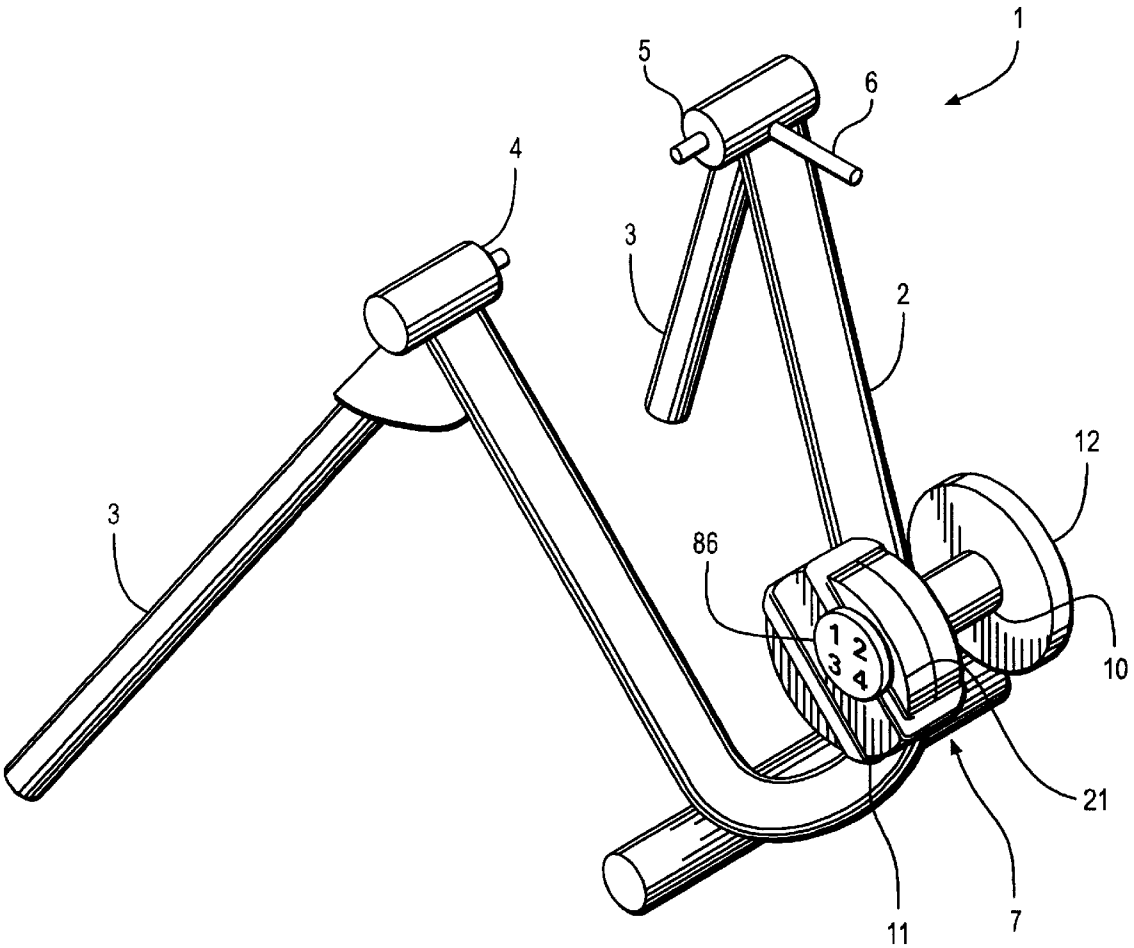
FIG. 8 is an isometric view of a bicycle trainer in accordance with the present invention, including an adjustable fluid resistance unit, another embodiment of the present invention.

In the following description, any references to right and left, top and bottom, upper and lower and horizontal and vertical are to be read and understood with their conventional meanings and with reference to viewing the embodiments of the exercise device and resistance unit of the present invention as shown in FIGS. 1 and 8, and FIG. 2, an elevational view of the device as it might be disposed ready for use. Elements or components common to depicted embodiments of the present invention are commonly numbered.

Referring then to the drawings, particularly FIGS. 1 and 2, a bicycle trainer embodiment of the present invention is shown ready for use. The bicycle trainer 1 has a generally U-shaped main frame 2 and retractable legs 3, preferably attached to the main frame and deployable to provide a stable base. The legs 3 fold to and away from the vertical upright portions of the frame 2 to allow the trainer 1 to be stored conveniently. The frame 2 and legs 3 of the bicycle trainer can be made in a variety of configurations, provided a bicycle and rider are held in a stable, upright position.

As shown in FIG. 2, the rear wheel 9 of a bicycle 8 is held in place by a pair of clamps 4 and 5. The position of one clamp 4 is fixed, and the other clamp 5 is movable by means of a handle 6. Together, the clamps 4, 5 allow a bicycle 8 to be positioned and securely held.

The fluid resistance unit 7 of the present invention includes a rotating shaft 10 for frictional contact with the rear wheel 9, an impeller unit 11 and a flywheel 12. The unit 7 is designed to be a moveable modular unit, and is attached to or carried by the frame 2 by a yoke 13. The modular design allows fluid resistance unit 7 to be separately then later assembled with the other components of bicycle trainer 1.

Figure 3:
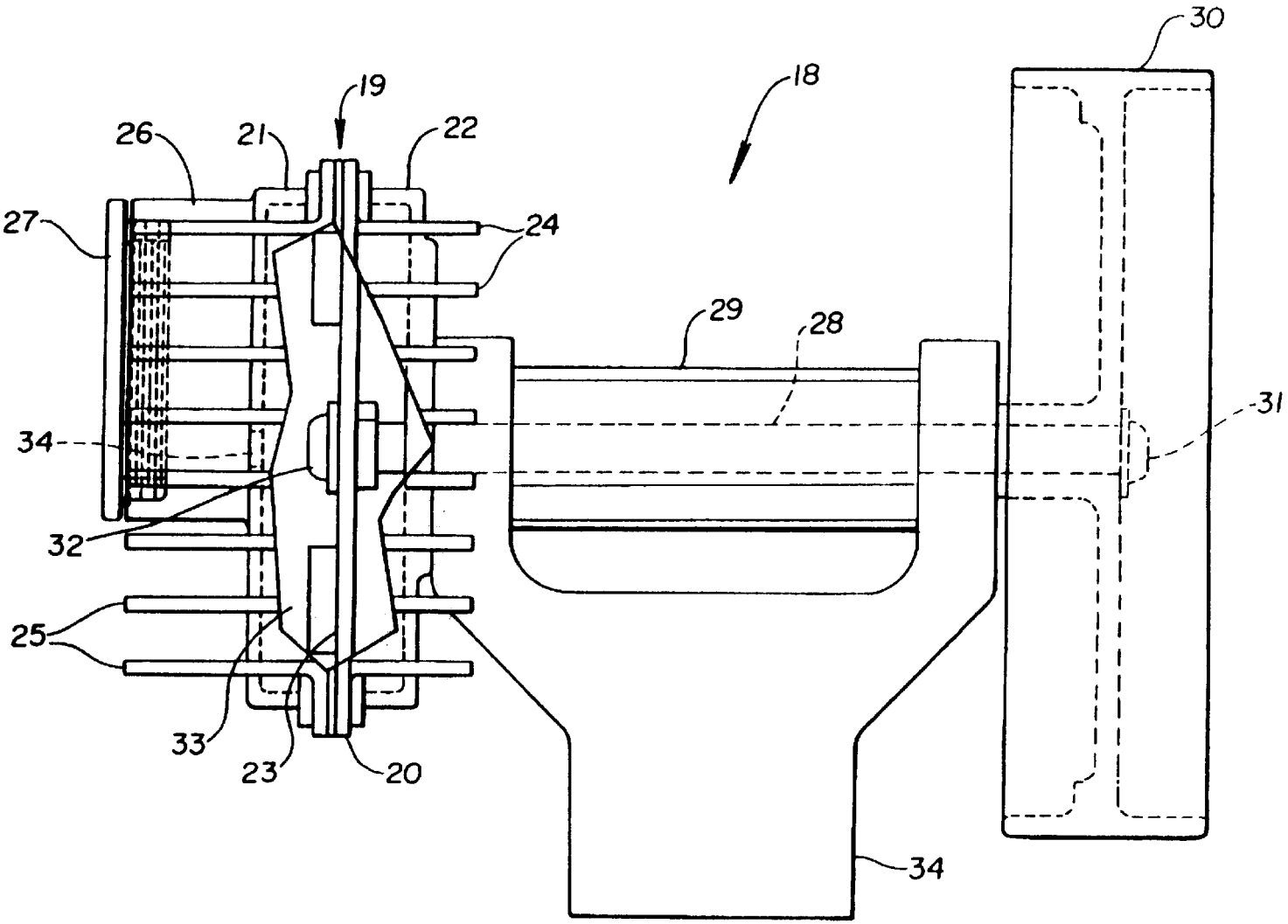
FIG. 3 is a front elevational view of the fluid resistance unit of the present invention with portions thereof in cross-section and with portions cut away.
Figure 5:
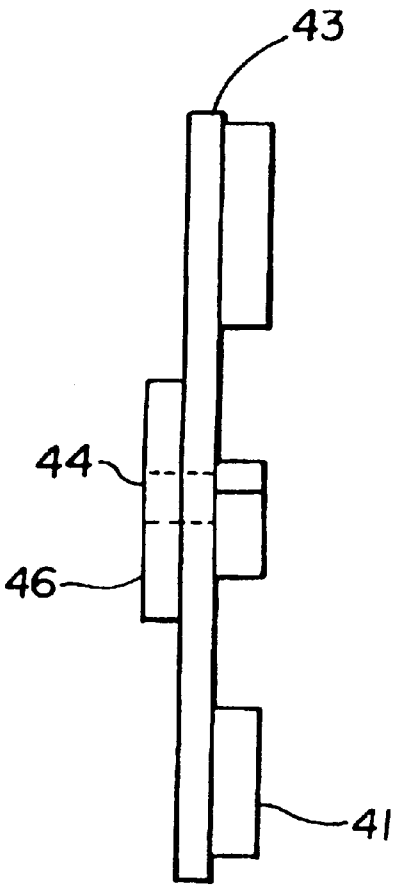
FIG. 5 is a front elevational view of the impeller depicted in FIG. 4.

One embodiment of the fluid resistance unit 7 is shown in FIG. 3. The unit 7 includes an impeller assembly and a drive assembly. The impeller assembly 19 includes a housing 20, depicted with a cutaway section to reveal the impeller 23 housed inside. The housing 20 comprises a first shell member 21 and a second shell member 22 fastened together to form a fluid-tight main chamber 33. The main chamber contains an amount of resistance fluid.

A variety of resistance fluids can be used in the resistance unit of the present invention. Although not an operational requirement, it is preferred that the resistance fluid be non-toxic. Generally, the resistance fluid should have a viscosity in the range of 1 to 500 cs. A larger impeller is required if the viscosity of the fluid is small. The resistance fluids that my be used include silicone compounds, vegetable oils, mineral oils, water-based lubricants, etc. In the preferred embodiment, the fluid used in the resistance unit is a silicone compound. Specifically, a pure silicone fluid with a 50 cs viscosity is used because of its high boiling point of about 400° F. When water is used as the resistance fluid, a small amount of water soluble oil is added to the fluid to provide lubricity and as an anti-corrosive agent. The resistance fluid chosen should have a low coefficient of compression.

Suitable gaskets (not shown) may be used to keep the joint between the shell members fluid-tight. The first shell member 21 has an expansion chamber 26 in fluid communication with the main fluid chamber 33 via a channel opening 34. It is preferred that the channel opening 34 be located near the center of the main chamber 33.

The expansion chamber 26 provides an area for the resistance fluid to expand and acts as a reservoir for extra fluid as well. The resistance fluid will expand as a result of frictional heat, and the expansion chamber 26 prevents the build up of internal pressure beyond the limits that can be maintained by the housing, specifically the joint between the shell members. If a silicon resistance fluid is used, the relationship between the volumes of the expansion chamber and main chamber is approximately 1.5:4.0.

The expansion chamber 26 has a removable, threaded cover 27. As shown, the shell members 21 have a plurality of external cooling vanes 25.

With continued reference to FIG. 3, an impeller 23 is fixedly mounted adjacent to the end of a generally horizontal, rotatable shaft 28 for rotation with the shaft. The impeller is seated on a nut-like seat and secured by a set screw or bolt 32. The impeller is situated generally in the center portion of the main chamber 33 and oriented within the housing 20 in a generally vertical position. Just outside the main chamber, the shaft carries a roller 29, basically a sleeve placed around shaft 28 to increase contact surface for frictionally contacting the drive wheel, i.e., the rear wheel of a bicycle.

The impeller 23 is generally a flat, two-sided circular plate or disc with protruding vanes extending from one side. This design of the impeller is asymmetrical. It should be understood that the impeller of the present invention may have various configurations without affecting the operation of the resistance unit, including a propeller, a paddle wheel, a screw, and the like. An inertial member 30, commonly known as a flywheel, is carried adjacent to the opposite end of the shaft 28, being secured in place by a screw 31. The entire resistance unit is connected to the trainer frame by support and mounting yoke 34.

Figure 4:
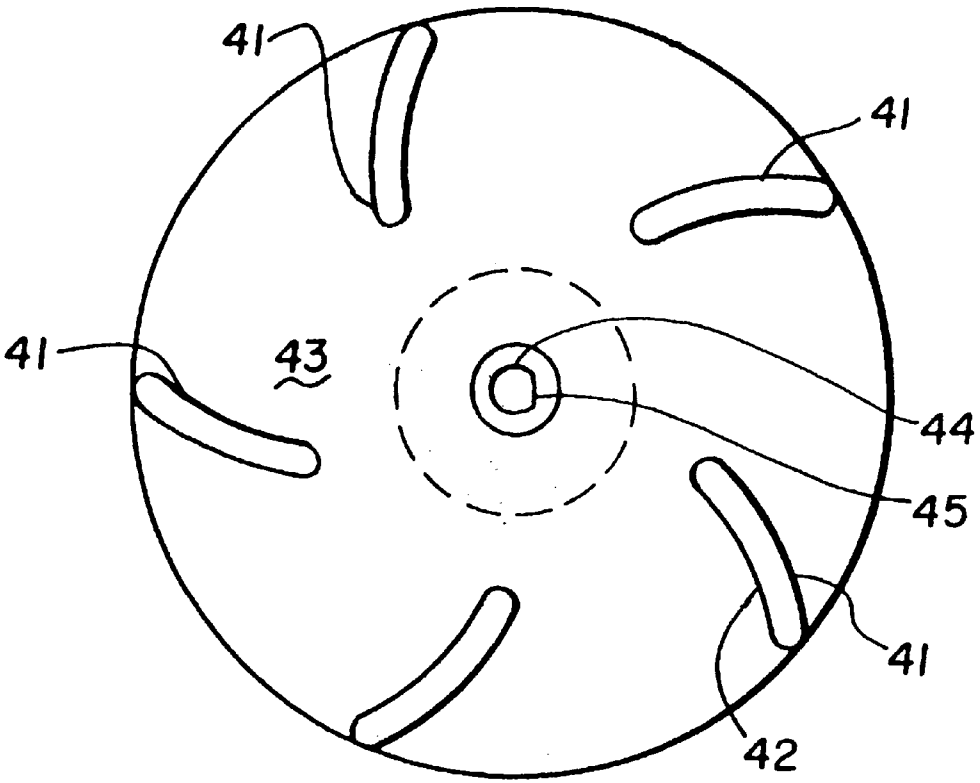
FIG. 4 is a side elevational view of an embodiment of the impeller of the present invention.
Figure 13:
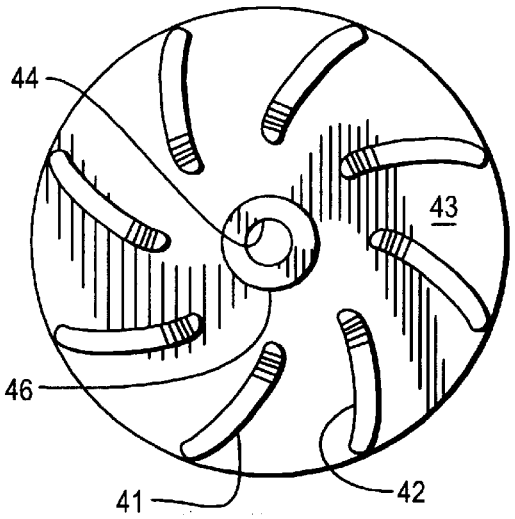
FIG. 13 is a elevational view of another embodiment of the impeller of the present invention.
Figure 14:
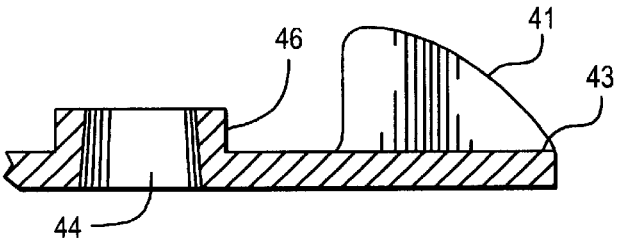
FIG. 14 is a side elevational view of impeller embodiment depicted in FIG. 13.

One embodiment of the impeller is depicted in FIG. 4, another, preferred, embodiment being depicted in FIGS. 13 and 14. The impeller 23 comprises a flat plate 43 carrying a plurality of vanes 41. The impeller has a central mounting hole 44 with a beveled portion 45 (FIG. 4 embodiment) and one side has a raised portion 46. The number of vanes may be varied, as may the size of the impeller and impeller housing. The preferred embodiment, depicted in FIG. 8, has eight vanes. The number of vanes is determined, in part, by the total surface area needed to provide resistance against the fluid. For a 2.8 inch diameter impeller, 1 to 8 vanes are preferred. It is more preferred that eight vanes are used, spaced apart equally around the circumference of the circular plate 43. The vanes 41 have curved surfaces 42 that are generally concave or curved in the direction of rotation, and are designed to reduce the possibility of cavitation. The curved surfaces move the resistance fluid by a scooping action thereby providing resistance to and during rotation. It is preferred that the curved surfaces 42 have radii of approximately 1.188 inches.

The vanes 41 may have a variety of shapes to provide the necessary resistance in the fluid with a lead surface more or less streamlined to provide less or more resistance, respectively, as the impeller 23 rotates in the fluid. It is within the scope of the invention to use vane lead surfaces that are flat, trapezoidal, curved, or the like, but it is preferred that the vane lead surface be offset at an angle from the radius of the impeller. The impeller 23 is preferably made of metal or metallic alloys using conventional methods, but other materials which may be used include refractory ceramics or plastics.

In the preferred embodiment of the present invention, the normal momentum of a bicycle, i.e., the feeling of "coasting," is simulated by the flywheel 12 attached to the rotating shaft. The flywheel 12 rotates in air and is not subjected to the same amount of resistance as the impeller 23 in the fluid. Consequently, the flywheel 12 tends to maintain a greater rotational momentum during the pedaling cycle when the pedal and crank are in the vertical position and the transfer of power to the drive wheel is at a minimum. Generally, and as usual, it is desirable to make the flywheel 12 as massive as possible, with most of the weight bering at the periphery. On the other hand, if the flywheel 12 is too heavy, the drive tire 9 may slip during acceleration. It is preferred, therefore, that the flywheel 12 have a weight in the range of 0.5 to 4.0 pounds.

Figure 7:
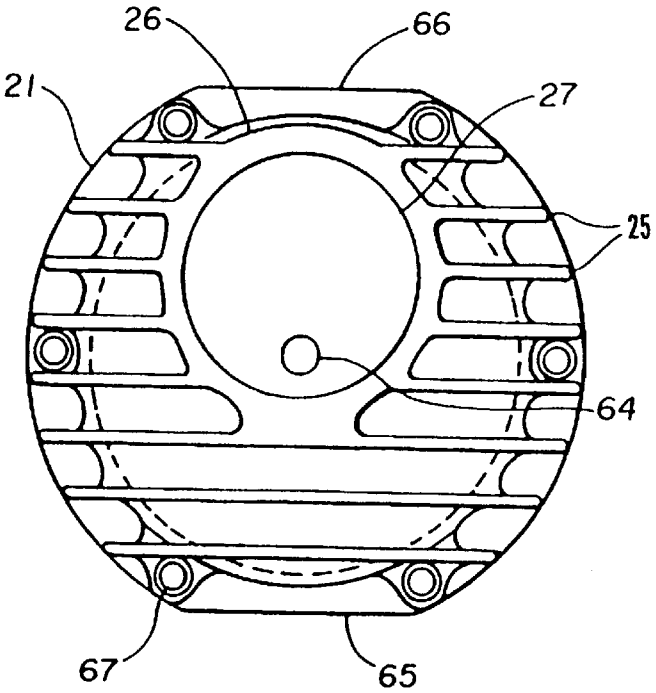
FIG. 7 is a side elevational view of the outer surface of the other half shell of the housing of the present invention.
Figure 6:
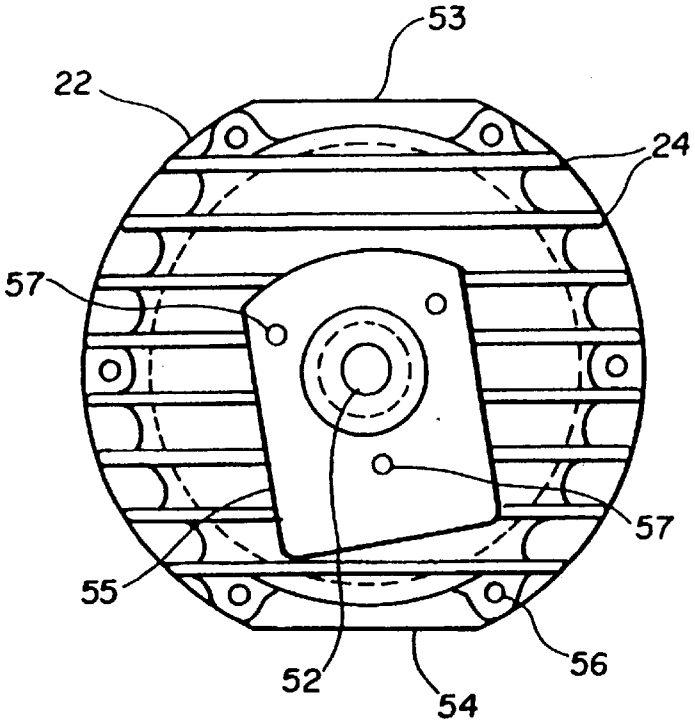
FIG. 6 is a side elevational view of the outer surface of one half shell of the housing of the present invention.

FIGS. 6 and 7 depict the housing shell members. As depicted in FIG. 6, one shell member 22 has top and bottom beveled portions 53, 54. The shell member 22 also has a flat central portion 55 contacting one side of the yoke (as depicted in FIG. 3). Connection is via screws or bolts carried in screw holes 57. Referring to FIG. 7, the other shell member 21 has top and bottom beveled portions 66, 65 and a screwhole 67 generally cooperating with those of the second shell member 22. The cover 27 provided in the second shell member has an indentation 64 used to assist in screwing and unscrewing the cover 27.

As depicted in FIGS. 3, 6 and 7, the outside surface of the housing 20 has a plurality of cooling fins or vanes 24 for dissipating heat generated by the rotation of the impeller 23 in the resistance fluid during exercise. The cooling vanes may be on the outer surface of either or both of shell members 21 and 22. The frictional heat that is generated during use may be substantial, and the vanes 24 and 25 cool the housing 20. The vanes 24 and 25 are horizontal and parallel, but their orientation may be vertical, or they may be a radial, or random non-parallel configuration as well. Whatever the orientation, the spacing between the fins must be sufficient to provide adequate transfer of heat to the surrounding air; the preferred minimum spacing is approximately 0.300 inches.

It is within the scope of the present invention to place internal baffles on the inner surface of the housing, i.e., on inner surfaces of either or both of shell members 21 and 22. The fluid dynamics of the rotation of the impeller 23 are such that if such baffles are used, the shearing action of the action of the fluid increases and the resistance is increased.

One of the advantages of the present invention is the lack of noise generated by the rotation of the impeller 23 in the resistance fluid. The quietness of the resistance unit is due, in part, to the fact that sound does not transmit easily through media having different densities.

The amount of resistance fluid used to fill the housing should be sufficient to substantially cover the vanes of the impeller 23. The housing is not entirely filled, a small volume of air being left to help accommodate thermal expansion of the fluid when the trainer is used. If the expansion chamber 26 is not used, there should be some form of compensatory mechanism provided for thermal expansion of the fluid. It is possible to change the fluid (e.g., the viscosity and the like thereof) used in the resistance unit to vary the resistance that can be obtained.

FIGS. 8–12 depict another embodiment of the resistance unit 7 of the present invention wherein a resistance adjustment feature is provided. Specifically, the expansion chamber 26 and cover 27 of the embodiment depicted in FIG. 1 have been adapted to provide for the manual adjustment of the degree or level of resistance provided by the resistance unit 7. The shell member 21 of the pair of shell members 21, 22 used to form the main or impeller chamber has been adapted by having a cylinder 80 mounted thereto or formed integrally therewith in the place of the chamber 26. The cylinder 80 may be press fit or other suitably mounted at the same location as the expansion chamber 26. An appropriate sealing structure 82 may be provided on the end of the cylinder 80 which has a substantially cylindrical hollow interior bore and two open ends.

Figure 9:
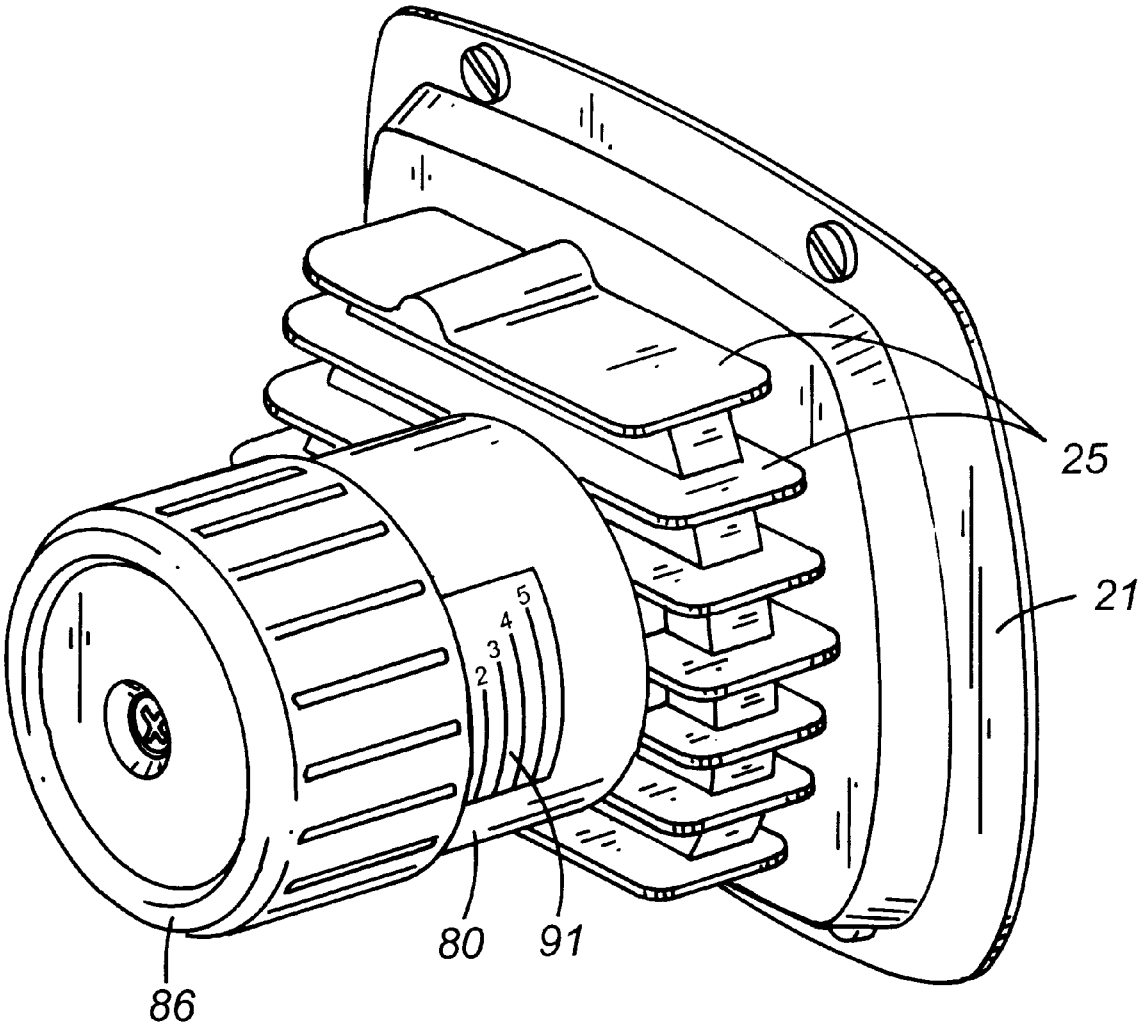
FIG. 9 is a side elevational view of the outer surface of the housing of the second embodiment of the present invention.
Figure 10:
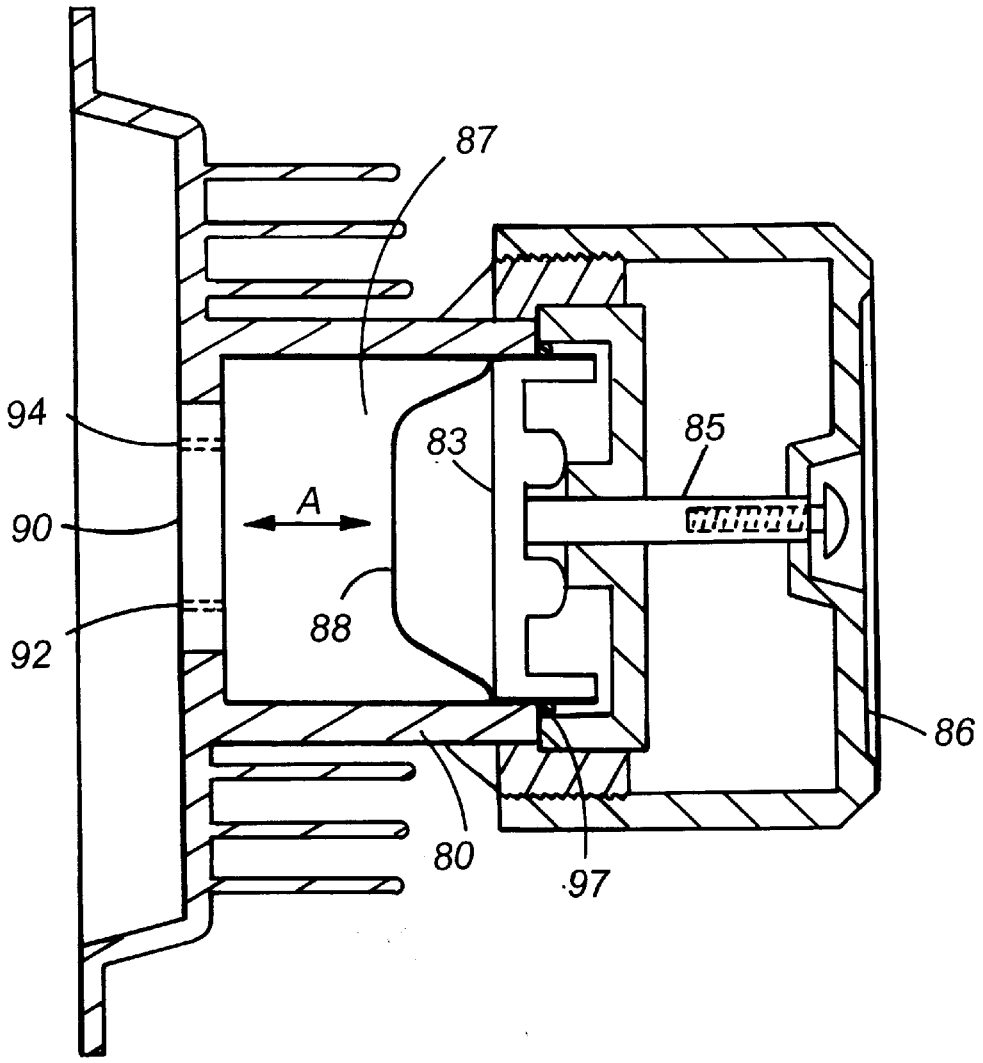
FIG. 10 is a side elevational view of the control feature for the fluid resistance unit of the present invention with portions thereof in cross-section and with portions cut away.
Figure 11:
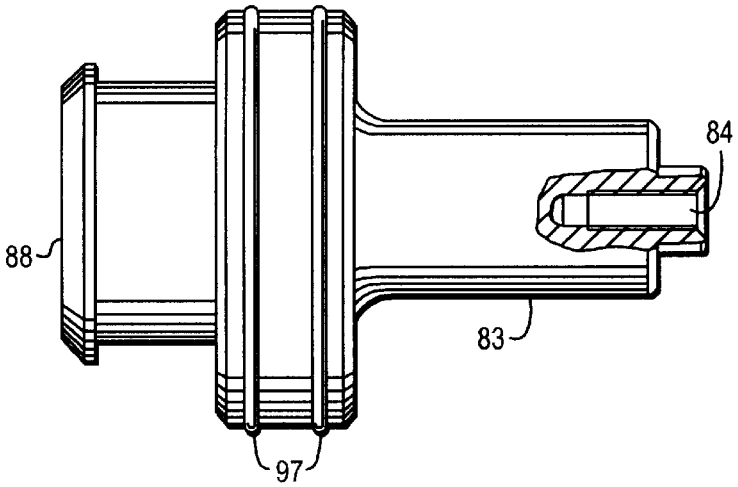
FIG. 11 is a side elevational view of the piston of the control feature of the present invention with portions thereof in cross-section and with portions cut away.
Figure 12:
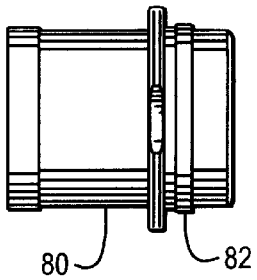
FIG. 12 is a side elevational view of the cylinder of the control feature of the present invention.

Referring to FIGS. 9 through 12, this embodiment of the resistance unit 7 includes a piston 83 adapted to be moveably, slidably received in the bore of the cylinder 80. The piston 83 includes drilled and tapped connective means 84 for being fixedly coupled, through a threaded, rigid pin or bolt 85, to a rotatable knob 86. As depicted in FIG. 10, the knob 86 is threadably received on the outside of the cylinder 80.

With continued reference to FIG. 10, together the piston 83 and cylinder 80 cooperatively define a resistance level adjustment fluid reservoir 87. One end of the reservoir 87 is sealed or closed by the free end 88 of the piston. The opposite end of the reservoir 87 is closed by a thin steel wall 90, substantially continuous with the inside wall of the impeller chamber 33. The wall 90 includes a first aperture 92 and a second aperture 94. The two apertures 92, 94 are substantially 180 degrees apart on a line of diameter of the generally circular wall 90. One of the holes 92, while on or adjacent to the lower peripheral edge of the wall 90, is generally located on or adjacent to the axis of rotation of the impeller 23 and the generally central region of the main chamber 33. The second hole 94, because the reservoir 87 is off center with respect to the main impeller chamber, is on the outside or end of a radius of the main impeller chamber 33. Although it is slightly preferred that the holes 92, 94 are on a vertical line or diameter of the wall 90, they can be arranged on a horizontal as well. The vertical arrangement is preferred because of gravity will thus help drain the reservoir 87.

Referring to FIG. 9, the outer diameter of the adjustment knob 86 may be ribbed or knurled to provide a sure grip, and the outside surface of the reservoir 87 (the cylinder 80) may include an indicator plate 91 for indicating the resistance setting.

Appropriate sealing means 97 (e.g., O-rings, gaskets, etc.) may be provided between the piston 83 and inside wall of the cylinder 80 to ensure adequate sealing of the expansion reservoir 87.

The resistant unit 7 of the present invention could broadly be considered a centrifugal pump, i.e., as the impeller 23 rotates or is driven by an exerciser, it throws liquid outwardly toward the walls of the impeller chamber 33 and toward the hole 94 adjacent to the wall of the main housing.

Recalling that the main impeller housing 33 is sealed with a certain quantity of liquid therein, referring to FIG. 10, if the reservoir chamber 87 is fully occupied by the piston 83 (i.e., closed or filled by the piston 83; not shown, but see arrow A for movement of the piston 83 in the cylinder 80), the impeller 23 will be immersed in a maximum level of fluid (i.e., all the fluid in the sealed housing). This translates into a maximum level of resistance and most difficult setting of the knob 86. The adjustment knob 86 may be used to retract the piston 83, moving it outwardly away from the main chamber 33, thereby opening the reservoir 87 to receive fluid as the impeller 23 rotates. Under the impetus of the impeller 23, fluid will move through the hole 94 into the reservoir 87, in effect lowering the fluid level in the impeller chamber 33. This translates into less resistance to the motion of the impeller 23 and an easiest setting of the resistance unit.

The following chart presents examples of ranges of performance data for the resistance units (both embodiments) of the present invention.

| MA-1 | Embodiment of FIG. 1 | Embodiment of FIG. 8 at easiest setting | Embodiment of FIG. 8 at most difficult setting |
|---|---|---|---|
| 1.5 | 0 | 0 | 0 |
| 4 | 1.4 | 1.4 | 1.5 |
| 8 | 3.3 | 2.9 | 4.5 |
| 11.3 | 4.8 | 4.1 | 6.8 |
| 14.5 | 6.2 | 5.3 | 9.3 |
| 16.0 | 7.0 | 6.5 | 10.6 |
| 19.4 | 8.9 | 7.8 | 13.7 |
| 22.6 | 10.8 | 9.2 | 16.0 |
| 25.8 | 12.2 | 10.7 | |

Although a description of a preferred embodiment has been presented, various changes, including those mentioned above, could be made without deviating from the spirit of the present invention. It is desired, therefore, that reference be made to the appended claims rather than to the foregoing description to indicate the scope of the invention.

What is claimed is:

1. A resistance unit for use with a bicycle exercise apparatus which supports a driven wheel of a bicycle by a stationary support frame, said resistance unit comprising:

a rotatable shaft in operable engagement with said driven wheel, said rotatable shaft being rotated when said driven wheel is rotated;

a housing and a first cavity associated with said housing, said first cavity-containing a fluid;

an impeller operably mounted in said first cavity and coupled to said rotatable shaft, said impeller having at least one vane, the fluid providing resistance against the rotation of said impeller;

a second cavity associated with said housing, said first and second cavities in fluid communication; and a pump including a screw operated piston, the pump arranged to control the flow of fluid between the first and second cavities.

2. The resistance unit in accordance with claim 1, wherein said impeller is immersed in the fluid, the fluid providing resistance against the rotation of said impeller.

3. The resistance unit in accordance with claim 2, wherein the degree to which the impeller is immersed in the fluid is selectively variable.

4. A resistance unit for use with an exercise device, said resistance unit removably mounted on a frame connected to the exercise device for providing selectively variable resistance and comprising:

a housing having an interior for receiving a rotatable impeller and containing a liquid, said impeller mounted on a rotatable shaft and at least partially immersed in the liquid, said impeller having at least one vane, the liquid providing resistance against the rotation of said impeller;

a reservoir associated with said housing, said interior and reservoir in fluid communication; and a screw operated piston associated with the housing and arranged to move liquid between said interior and reservoir.

5. The resistance unit in accordance with claim 4, wherein a flow of the liquid into the interior increases the portion of the impeller immersed in the liquid, and a flow out of the interior space decreases the portion of the impeller immersed in the liquid, thereby respectively increasing and decreasing resistance to the rotation of the impeller.

6. A resistance applying device according to claim 4, wherein the interior has inner surfaces, said inner surfaces having a plurality of internal baffles for increasing resistance against the rotation of said impeller.

7. A fluid resistance device for a bicycle trainer having a support frame releasably connected to a rear wheel of a bicycle, said resistance device comprising:

a rotatable shaft in frictional contact with said rear wheel and held in a generally horizontal position by a yoke movably attached to said frame, said rotatable shaft having first and second ends;

an impeller attached to said first end of said rotatable shaft and having at least one vane, said impeller being rotatable by said rotatable shaft;

a sealed housing having an impeller chamber for receiving said impeller and containing a fluid for providing resistance against the rotation of said impeller, said housing having a plurality of cooling fins and being operably attached to said yoke;

a second chamber in fluid connection with said impeller chamber;

a pump including a screw operated piston associated with the housing and arranged to selectively move fluid between said impeller chamber and second chamber; and a fly wheel attached to said second end of said rotatable shaft to moving in unison with said impeller.

8. The fluid resistance device in accordance with claim 7, wherein the degree to which the impeller is immersed in the fluid is selectively variable.

* * * * *